US012076791B2

(12) United States Patent
Ishimine et al.

(10) Patent No.: US 12,076,791 B2
(45) Date of Patent: Sep. 3, 2024

(54) METHOD OF MAKING SINTERED BODY, AND POWDER COMPACT

(71) Applicants: SUMITOMO ELECTRIC INDUSTRIES, LTD., Osaka (JP); SUMITOMO ELECTRIC SINTERED ALLOY, LTD., Okayama (JP)

(72) Inventors: Tomoyuki Ishimine, Osaka (JP); Shigeki Egashira, Osaka (JP); Munehiro Noda, Osaka (JP); Takayuki Tashiro, Osaka (JP); Kazunari Shimauchi, Osaka (JP)

(73) Assignees: SUMITOMO ELECTRIC INDUSTRIES, LTD., Osaka (JP); SUMITOMO ELECTRIC SINTERED ALLOY, LTD., Okayama (JP)

( * ) Notice: Subject to any disclaimer, the term of this patent is extended or adjusted under 35 U.S.C. 154(b) by 171 days.

(21) Appl. No.: 17/594,124

(22) PCT Filed: Apr. 13, 2020

(86) PCT No.: PCT/JP2020/016336

§ 371 (c)(1),
(2) Date: Oct. 4, 2021

(87) PCT Pub. No.: WO2020/218069

PCT Pub. Date: Oct. 29, 2020

(65) Prior Publication Data

US 2022/0152701 A1 May 19, 2022

(30) Foreign Application Priority Data

Apr. 24, 2019 (JP) ..... 2019-082632

(51) Int. Cl.
*B22F 3/16* (2006.01)
*B22F 1/00* (2022.01)

(52) U.S. Cl.
CPC ..... *B22F 3/162* (2013.01); *B22F 1/09* (2022.01); *B22F 2301/35* (2013.01); *B22F 2998/10* (2013.01); *B22F 2999/00* (2013.01)

(58) Field of Classification Search
CPC .... B22F 3/162; B22F 3/16; B22F 5/00; B22F 5/085; B22F 5/10
See application file for complete search history.

(56) References Cited

U.S. PATENT DOCUMENTS 6,730,263 B2 * 5/2004 Ernst ..... B22F 5/08 419/38
2007/0271789 A1 * 11/2007 Kondo ..... F16C 33/145 29/893

(Continued)

FOREIGN PATENT DOCUMENTS

JP H10-166188 6/1998
JP 2005-336608 12/2005

(Continued)

OTHER PUBLICATIONS

German R. M., Tr. Miura, Hideshi et al., Powder Metallurgy Science, First Edition, Uchida Rokakuho Publishing Co., Ltd., Jun. 25, 1996, pp. 244-247, ISBN:4-7536-5091-X, with English concise explanation.

(Continued)

*Primary Examiner* — Sally A Merkling
*Assistant Examiner* — Ricardo D Morales
(74) *Attorney, Agent, or Firm* — IPUSA, PLLC

(57) ABSTRACT

A method of making a sintered body includes a step of preparing raw material powder containing powder of inorganic material, a step of producing a powder compact having a high-density portion with a relative density of 93% or more and a low-density portion with a relative density of less than 93% by compressing the raw material powder injected into a mold, a step of producing a machined compacted part by machining at least the high-density portion of the powder compact, and a step of sintering the machined compacted part to make a sintered body, wherein a perimeter shape of (Continued)

a cavity constituted by the mold in a cross-section perpendicular to an axial direction of the mold is such than a maximum stress applied to an inner perimeter surface of the mold during a compacting process using the mold is less than or equal to 2.6 times an imaginary maximum stress that is applied to an inner perimeter surface of an imaginary mold during a compacting process using the imaginary mold, the imaginary mold having an imaginary cavity that has a same area as the cavity and that has a circular perimeter shape.

7 Claims, 15 Drawing Sheets

(56) References Cited

U.S. PATENT DOCUMENTS

| | | | |
|---|---|---|---|
| 2007/0283778 | A1 | 12/2007 | Ichikawa et al. |
| 2008/0025866 | A1 | 1/2008 | Kondoh et al. |
| 2013/0336830 | A1 | 12/2013 | Hlirai |
| 2018/0236548 | A1 | 8/2018 | Ishimine et al. |
| 2021/0162499 | A1 | 6/2021 | Ishimine et al. |

FOREIGN PATENT DOCUMENTS

| | | | | |
|---|---|---|---|---|
| JP | 2006-161070 | | 6/2006 | |
| JP | 2007-262536 | | 10/2007 | |
| JP | 2017-186625 | | 10/2017 | |
| JP | 2017186625 | A * | 10/2017 | ..... B22F 1/0007 |
| WO | 2012/077750 | | 6/2012 | |
| WO | 2018/216461 | | 11/2018 | |

OTHER PUBLICATIONS

International Search Report for PCT/JP2020/016336 mailed on Jun. 30, 2020.

* cited by examiner

CIRCULAR ELLIPSE 1.28 ELLIPSE 1.55
ELLIPSE 1.92 VARIANT

METHOD OF MAKING SINTERED BODY, AND POWDER COMPACT

TECHNICAL FIELD

The disclosures herein relate to methods of making a sintered body and powder compacts.

The present application is based on and claims priority to Japanese patent application No. 2019-082632 filed on Apr. 24, 2019, and the entire contents of the Japanese patent application are hereby incorporated by reference.

BACKGROUND ART

A method of making a sintered body using a powder compact is disclosed in Patent Document 1. This method first compresses raw material powder containing iron-based metal powder to produce a powder compact having an average relative density of 93% or more. Then, the powder compact is machined to produce a machined compacted part. The machined compacted part is sintered to make a sintered body.

RELATED-ART DOCUMENTS

Patent Document

[Patent Document 1] Japanese Laid-open Patent Application No. 2017-186625

SUMMARY OF THE INVENTION

A method of making a sintered body according to the present disclosures includes a step of preparing raw material powder containing powder of inorganic material, a step of producing a powder compact having a high-density portion having a relative density of 93% or more and a low-density portion having a relative density of less than 93% by compressing the raw material powder injected into a mold, a step of producing a machined compacted part by machining at least the high-density portion of the powder compact, and a step of sintering the machined compacted part to make a sintered body, wherein a perimeter shape of a cavity constituted by the mold in a cross-section perpendicular to an axial direction of the mold is such than a maximum stress applied to an inner perimeter surface of the mold during a compacting process using the mold is less than or equal to 2.6 times an imaginary maximum stress that is applied to an inner perimeter surface of an imaginary mold during a compacting process using the imaginary mold, the imaginary mold having an imaginary cavity that has a same area as the cavity and that has a circular perimeter shape.

A powder compact of the present disclosures is a powder compact containing powder of inorganic material having a shape of a circular cylinder, a circular tube, an elliptical cylinder, or an elliptical tube, wherein a high-density portion situated on one of an inner circumference side and an outer circumference side of the powder compact and a low-density portion situated on another one of the inner circumference side and the outer circumference side of the powder compact are provided, and wherein the relative density of the high-density portion is greater than or equal to 93%, and the relative density of the low-density portion is less than 93%.

MODE FOR CARRYING OUT THE INVENTION

Figure 1:
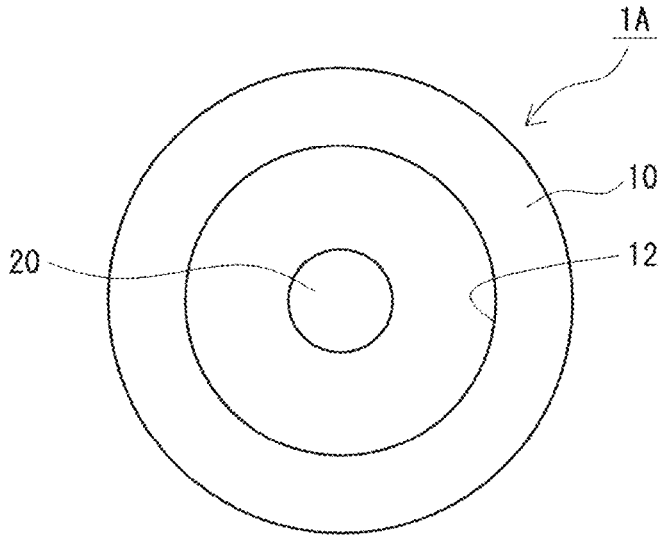
FIG. 1 is a plan view of a mold used in a production method according to an embodiment.

Problem to be Solved by the Present Disclosures

A method of making a sintered body according to Patent Document 1 enables efficient production of a sintered body having a complex shape by applying a machining process such as cutting and processing to a powder compact, which is easier to be machined than a sintered body. There is also a strong need for further weight reduction and cost reduction of sintered bodies.

One of the objects of the present disclosures is to provide a powder compact that has a portion with a locally different density. Another object of the present disclosures is to provide a method of making a sintered body using the above-noted powder compact.

Advantage of the Present Disclosures

According to the method of making a sintered body, a sintered body that has a different density portion can efficiently be made without damaging a mold for compaction.

The powder compact of the present disclosures can be used as a precursor of a sintered body that has a different density portion, thereby allowing various complex shapes required of sintered bodies to be readily made through machining.

Description of Embodiments of the Present Disclosures

Embodiments of the present disclosures will be listed and described first.

(1) A method of making a sintered body according to an embodiment includes:

a step of preparing raw material powder containing powder of inorganic material;

a step of producing a powder compact having a high-density portion with a relative density of 93% or more and a low-density portion with a relative density of less than 93% by compressing the raw material powder injected into a mold;

a step of producing a machined compacted part by machining at least the high-density portion of the powder compact; and a step of sintering the machined compacted part to make a sintered body, wherein a perimeter shape of a cavity constituted by a mold in a cross-section perpendicular to an axial direction of the mold is such than a maximum stress applied to an inner perimeter surface of the mold during a compacting process using the mold is less than or equal to 2.6 times an imaginary maximum stress that is applied to an inner perimeter surface of an imaginary mold during a compacting process using the imaginary mold, the imaginary mold having an imaginary cavity that has a same area as the cavity and that has a circular perimeter shape.

A ratio of the maximum stress applied to the inner perimeter surface of the mold during a compacting process using the mold to the imaginary maximum stress applied to the inner perimeter surface of the imaginary mold during a compacting process using the imaginary mold may sometimes be referred to as "a maximum stress ratio". According to the method of making a sintered body as described above, a sintered body can efficiently be made. This is because a machining process is performed with respect to a powder compact, which is far easier to be machined than a sintered body. A machining process applied to a powder compact enables efficient machining even when a sintered body having a complex shape is required. According to the method of making a sintered body as described above, damage to the mold can be significantly reduced or prevented at the time of compacting a powder compact. This is because the perimeter shape of the cavity constituted by the mold at a cross-section perpendicular to the axial direction of the mold is such that the maximum stress ratio is less than or equal to 2.6. As a result, a local concentration of stress on the mold is unlikely to occur, thereby substantially avoiding damage such as a crack to the mold. According to the method of making a sintered body, the consumption of raw material powder is reduced, compared with the case in which the entirety of a powder compact is made to have high density. With this, weight reduction of a sintered body is also achieved. This is because the powder compact has not only a high-density portion but also a low-density portion, which reduces the mass as a whole. The high-density portion may be formed at the portion of the resultant sintered body which is subjected to sliding motion and which is thus required to have high strength, high rigidity, and abrasion resistance. This can improve the mechanical characteristics of the sintered body.

(2) One aspect of the method of making a sintered body according to the embodiment may be configured such that the inorganic material contains at least one of an iron-based metal and a non-iron metal.

According to the configuration noted above, metal parts, such as gears or sprockets, made of an iron-based metal or a non-iron metal can suitably be made of a sintered body.

(3) One aspect of the method of making a sintered body according to the embodiment may be configured such that the powder compact has an annular shape with an inner circumference and an outer circumference, the high-density portion being situated on one of the inner circumference side and the outer circumference side, and the low-density portion being situated on the other one of the inner circumference side and the outer circumference side.

According to the configuration noted above, a sintered body having a sliding portion continuously extending in a circumferential direction, such as a gear, can efficiently be made. For example, in the case of an external gear, a powder compact having a simple shape may have a high-density portion on the outer circumference side, and may have a low-density portion on the inner circumference side, thereby providing teeth with high rigidity and excellent abrasion resistance. In the case of an internal gear, a powder compact having a simple shape may have a high-density portion on the inner circumference side, and may have a low-density portion on the outer circumference side, thereby providing teeth with high rigidity and excellent abrasion resistance.

(4) One aspect of the method of making a sintered body according to the embodiment may be configured such that a difference in relative density between the high-density portion and the low-density portion is greater than or equal to 3%.

According to the configuration noted above, sufficient weight reduction can be achieved with respect to the powder compact and the sintered body obtained in final form. This is because any substantial difference in relative density between the high-density portion and the low-density portion has a large effect to reduce the entire weight of a sintered body.

(5) One aspect of the method of making a sintered body according to the embodiment may be configured such that the shape of the powder compact is a circular cylinder, a circular tube, an elliptical cylinder, or an elliptical tube.

According to the configuration noted above, a local stress being applied to the mold during the compression of raw-material powder can be sufficiently reduced, which can effectively reduce damage to the mold. This is because any simple shape of a powder compact such as a circular cylinder or a circular tube makes it less likely for a local stress to be concentrated on the mold during the compression of raw-material powder. which substantially prevents the occurrence of damage such as a crack to the mold.

(6) One aspect of the method of making a sintered body according to the embodiment may be configured such that the mold includes a die disposed around the outer perimeter of the raw-material powder, and the inner perimeter of the die has an arc-shaped curve.

wherein a minimum radius R of the curve is greater than or equal to 10 mm.

According to the configuration noted above, the inner perimeter of a die does not have a curve whose radius is less than 10 mm, so that a local stress being applied to the mold during the compression of raw-material powder can be sufficiently reduced, which can effectively reduce damage to the mold.

(7) One aspect of the method of making a sintered body according to the embodiment may be configured such that the sintered body is an external gear or an internal gear.

According to the configuration noted above, gear teeth for which high rigidity and abrasion resistance are required are formed in the high-density portion, so that a sintered body can provide a gear having excellent mechanical characteristics.

(8) One aspect of the method of making a sintered body according to the embodiment may be configured such that the relative density of the high-density portion is greater than or equal to 97%.

According to the configuration noted above, use of a particularly high density for the high-density portion allows a portion having almost no void to be formed in a sintered body, thereby being able to provide a sintered body having high rigidity and abrasion resistance.

(9) A powder compact according to the embodiment is a powder compact containing inorganic-material powder having a shape of a circular cylinder, a circular tube, an elliptical cylinder, or an elliptical tube, wherein a high-density portion situated on one of an inner circumference side and an outer circumference side of the powder compact and a low-density portion situated on the other one of the inner circumference side and the outer circumference side of the powder compact are provided, and wherein the relative density of the high-density portion is greater than or equal to 93%, and the relative density of the low-density portion is less than 93%.

According to the powder compact noted above, damage to the mold can be reduced during the compression of raw-material powder. This is because the shape of the powder compact is a simple shape such as a circular cylinder or a circular tube, so that a local stress is not likely to be concentrated on any local point of the mold. Such a powder compact can preferably be used as a starting material for a sintered body which is required to have a complex shape. A powder compact is not such that individual particles constituting the compact are bonded together. Due to this property of a powder compact, the load of machining such as cutting and processing is far lower than in the case of a sintered body, which allows efficient machining. Especially, the powder compact noted above can preferably be used as a starting material for a sintered body of which a sliding portion has high rigidity and excellent abrasion resistance. This is because, with the provision of the high-density portion and the low-density portion, use of the high-density portion of the powder compact for a sliding portion of a sintered body allows a sintered body having high rigidity and excellent abrasion resistance at the sliding portion to be obtained. Further, the consumption of raw-material powder for the powder compact can be reduced, and weight reduction can be achieved. This is because the powder compact as a whole has not only the high-density portion but also the low-density portion.

(10) One aspect of the powder compact according to the embodiment may be configured such that the inorganic material contains at least one of an iron-based metal and a non-iron metal.

According to the configuration noted above, the powder compact can preferably be used as a starting material for a sintered body such as a gear or a sprocket which is made of metal such as an iron-based metal or a non-iron metal.

(11) One aspect of the powder compact according to the embodiment may be configured such that a difference in relative density between the high-density portion and the low-density portion is greater than or equal to 3%.

According to the configuration noted above, sufficient weight reduction can be achieved with respect to a sintered body that is made from the above-noted powder compact serving as a starting material. This is because any substantial difference in relative density between the high-density portion and the low-density portion has a large effect to reduce the entire weight of a sintered body.

Details of Embodiments of the Present Disclosures

In the following, specific examples of the embodiments of the present disclosures will be described with reference to the accompanying drawings. In the drawings, the same reference characters represent elements having the same names. The present disclosures are not limited to those examples, and are intended to include any variations and modifications which may be made without departing from the scope of the claims and from the scope warranted for equivalents of the claimed scope.

First Embodiment

<<Outline of Method of Making Sintered Body>>

A method of making a sintered body according to the embodiment includes the following steps.

S1. Preparation Step: raw material powder containing powder of inorganic material is prepared.

S2. Compacting Step: the raw material powder is injected into a mold and compressed to produce a powder compact having a predetermined shape which has a high-density portion having a relative density of 93% or more and a low-density portion having a relative density of less than 93%.

S3. Machining Step: at least the high-density portion of the powder compact is machined to produce a machined compacted part.

S4. Sintering Step: the machined compacted part is sintered to make a sintered body.

S5. Finishing Step: a finishing process is performed to bring the dimensions of the sintered body closer to the designed dimensions.

In the following, each step will be described in detail.

<<S1. Preparation Step>>

[Inorganic-Material Powder]

Inorganic-material powder is a main-component material that constitutes a sintered body. Examples of powder of inorganic material include metal powder and ceramic powder. Examples of metal powder include iron-based powder and non-iron metal powder. As iron-based powder, pure iron powder or iron-alloy powder having iron as a main component may be used. Here, the phrase "an iron alloy having iron as a main component" means that an iron element, as a content of the raw-material powder, accounts for 50 mass % or more, preferably 80 mass % or more, and more preferably 90 mass % or more. Examples of an iron alloy include those which contain at least one alloying element selected from the group consisting of Cu (copper), Ni (nickel), Sn (tin), Cr (chromium), Mo (molybdenum), Mn (manganese), Co (cobalt), Si (silicon), Al (aluminum), P (phosphorus), Nb (niobium), V (vanadium), and C (carbon). Such an alloying element contributes to the improvement of mechanical characteristics of an iron-based sintered body. Among the alloying elements, the content of Cu, Ni, Sn, Cr, Mo, Mn, Co, Si, Al, P, Nb, and V may be greater than or equal to 0.5 mass % and less than or equal to 5.0 mass %, and further preferably greater than or equal to 1.0 mass % and less than or equal to 3.0 mass S. The content of C may be greater than or equal to 0.2 mass % and less than or equal to 2.0 mass %, and further preferably greater than or equal to 0.4 mass % and less than or equal to 1.0 mass %. Moreover, iron powder may be used as metal powder, and powder of one or more alloying elements noted above (alloying powder) may be added to the iron powder. In this case, the content of the metal powder when serving as raw-material powder is iron and one or more alloying elements. When sintered in a subsequent sintering process, iron reacts with the one or more alloying elements to be turned into an alloy.

Examples of non-iron metal powder include at least one selected from the group consisting of Ti, Zn, Zr, Ta, and W, in addition to Cu, Ni, Sn, Cr, Mo, Mn, Co, Si, Al, P, Nb, and V noted above. Raw-material powder having non-iron metal as a main component may be used. Here, the phrase "raw-material powder having non-iron metal as a main component" means that non-iron metal powder, as a content of the raw-material powder, accounts for 50 mass % or more, preferably 80 mass % or more, and further preferably 90 mass % or more. The non-iron metal powder may be powder of a selected element alone which is used as the raw-material powder, or alloy powder obtained in advance by alloying selected elements which is used as the raw-material powder. Specific examples of non-iron metal alloys include copper alloys, aluminum alloys, titanium alloys, and the like.

The content of metal powder (which can be alloying powder) in the raw-material powder may be greater than or equal to 90 mass %, and further preferably greater than or equal to 95 mass %. The metal powder may be one of those which are made by water atomization, gas atomization, a carbonyl process, a reduction process, or the like, for example.

Further in accordance with need, the raw-material powder may contain ceramic powder. Specific examples of ceramics include aluminum oxide, zirconium oxide, silicon carbide, silicon nitride, boron nitride, and the like. The content of ceramic powder is less than or equal to 20 mass %, and is particularly less than or equal to 10 mass %. The raw-material powder does not have to contain ceramic powder.

The average particle diameter of raw-material powder, i.e., the average particle diameter of metal powder, may be greater than or equal to 20 μm and less than or equal to 200 μm, and further preferably greater than or equal to 50 μm and less than or equal to 150 μm, for example. Use of raw-material powder having an average particle diameter falling within the above-noted range ensures easy handling and easy compacting at the subsequent compacting step (S2). Further, use of metal powder having an average particle diameter greater than or equal to 20 μm allows the fluidity of raw material powder to be easily obtained. Use of metal powder having an average particle diameter less than or equal to 200 μm allows a sintered body having a compact structure to be easily obtained. The average particle diameter of metal powder refers to an average diameter of particles constituting the metal powder, and refers to a particle diameter (D50) at which the cumulative volume is 50% in the particle size distribution measured by a laser diffraction particle size distribution analyzer. Use of fine-particle metal powder makes it possible to reduce the surface coarseness of a sintered member and to provide a sharp edge at corners.

[Miscellaneous]

In a pressing process using a mold, raw material powder obtained by mixing powder of inorganic material and a lubricant may typically be used. The reason is to prevent powder of inorganic material from being stuck on the mold. Notwithstanding this, the embodiment is such that no lubricant is used in raw-material powder, or any lubricant contained therein is less than or equal to 0.3 mass % of the total raw-material powder. The reason is to reduce the extent to which the proportion of metal powder in the raw-material powder drops, thereby to provide a powder compact with the high-density portion having a relative density of 93% or more in the subsequent compacting step. It may be noted, however, that a small amount of lubricant may be added to the raw-material powder to the extent to which a powder compact with the high-density portion having a relative density of 93% or more can be produced in the subsequent compacting step. A metallic soap such as lithium stearate, zinc stearate, or the like may be used as the lubricant. In the instant specification, a lubricant mixed in the raw-material powder may sometimes be referred to as an internal lubricant. A lubricant which is not mixed in the raw-material powder but applied to a mold may sometimes be referred to as an external lubricant.

An organic binder may be added to the raw-material powder in order to reduce the occurrence of a crack or a chip in a powder compact in the subsequent compacting step. Examples of organic binders include polyethylene, polypropylene, polyolefin, polymethylmethacrylate, polystyrene, polyvinyl chloride, polyvinylidene chloride, polyamide, polyester, polyether, polyvinyl alcohol, vinyl acetate, paraffin, various waxes, or the like, for example. The organic binder may be added according to need, and may not necessarily be added. Any added organic binder needs to be in such an amount as to enable the production of a powder compact with the high-density portion having a relative density of 93% or more in the subsequent compacting step. The amount of an added organic binder may be less than or equal to 0.9 mass % of the total raw-material powder, for example.

<<S2. Compacting Step>>

In the compacting step, a mold is used to compress raw-material powder to produce a powder compact. The mold includes a die and a plurality of punches inserted into the upper and lower openings of the die, and may be configured such that raw-material powder inserted into the cavity of the die is compressed between the upper punch and the lower punch. Compression needs to be performed such that a powder compact has a predetermined high-density portion and low-density portion. It is thus preferable to use a plurality of punches that can be advanced and retracted independently of each other. Specifically, at least one of the upper punch and the lower punch may be configured as an inner punch and an outer punch. Preferably, both the upper punch and the lower punch are configured as an inner punch and an outer punch. At least one of the upper punch and the lower punch may be configured as three or more punches such as an inner punch, a middle punch, and an outer punch according to need.

The contour shape of an inner cross-section of the mold is shaped such that a maximum stress ratio is less than or equal to 2.6. This cross-section is a cross section perpendicular to the axial direction of the mold. The contour shape of the mold refers to the shape of a perimeter of the cavity formed by the mold at the above-noted cross-section. As was previously described, the maximum stress ratio refers to a ratio of the maximum stress applied to the inner perimeter surface of the mold during a compacting process using the mold to the imaginary maximum stress applied to the inner perimeter surface of an imaginary mold during a compacting process using the imaginary mold that has a circular perimeter shape and an imaginary cavity of the same area as the above-noted cavity. The maximum stress ratio indicates that the smaller the ratio is, the less concentration of stress occurs to the mold. The maximum stress ratio of the mold less than or equal to 2.6 can reduce the concentration of stress to the mold at the time of compacting a powder compact. With this reduction in stress concentration, damage to the mold can be reduced. The maximum stress ratio is preferably less than or equal to 2.5, more preferably less than or equal to 2.0, and particularly more preferably less than or equal to 1.5.

The functioning of the mold as described above during compaction will be described by taking an example in which the mold is used to produce a powder compact that is a flattened circular tube member having a through hole at the center and that has an annular shape with an inner circumference and an outer circumference, with a high-density portion on the outer-circumference side and a low-density portion on the inner-circumference side. In the following, three different aspects of the compacting step will be described as a compacting step A through a compacting step C.

(Compacting Step A)

Figure 2A:
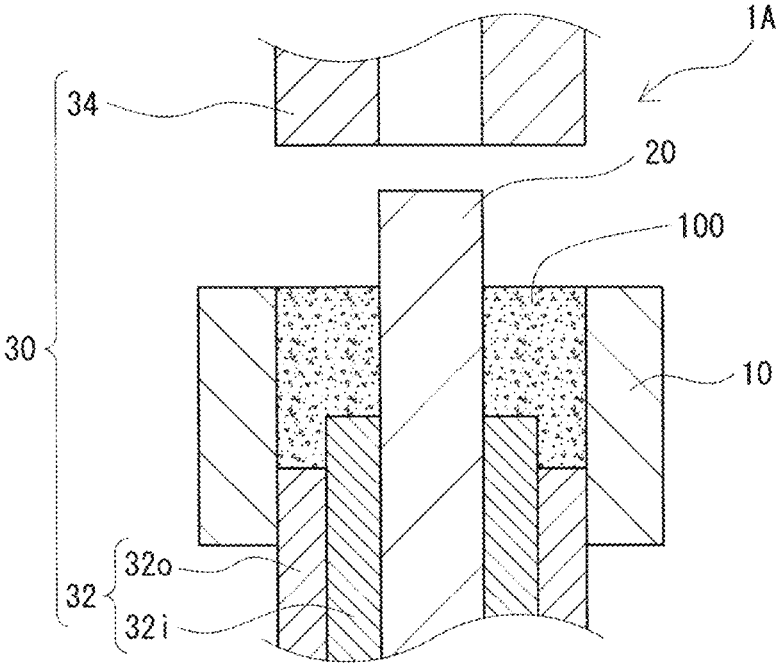
FIG. 2A is an illustrative drawing showing the state of a mold prior to compression in a production method according to the embodiment.

A mold 1A used in the compacting step A includes a circular tube die 10 and a core rod 20 having a round rod shape disposed at the center of the die 10, as illustrated in FIG. 1. A die hole 12 is formed between the inner circumferential surface of the die 10 and the outer circumferential surface of the core rod 20. A circular-tube lower punch 32 and upper punch 34 are disposed in the die hole 12 (FIG. 2A). A punch 30 is configured such that a lower inner punch 32*i* situated on the inner-circumference side and a lower outer punch 32*o* situated on the outside thereof are a pair of tubular punches, and the upper punch 34 is a singular tubular punch, as illustrated in FIG. 2A.

Initially, the upper punch 34 is in a lifted position, and the lower punch 32 is in a lowered position while the upper end face of the core rod 20 protrudes relative to the upper end face of the die 10. In this state, the state of the lower punch 32 is such that the lower outer punch 32*o* is lowered to a deeper position than the lower inner punch 32*i*. Namely, when a space surrounded by the inner circumferential surface of the die 10, the outer circumferential surface of the core rod 20, and the upper end faces of the two lower punches 32*i* and 32*o* serves as a cavity, a step is formed between the upper end face of the lower inner punch 32*i* and the upper end face of the lower outer punch 32*o* which form the bottom surface of the cavity.

Raw-material powder 100 is injected into the cavity. Since the bottom surface of the cavity has a step, with the outer-circumference side being deeper than the inner-circumference side, the amount of injected raw-material powder 100 on the outer-circumference side is greater than the amount of injected raw-material powder 100 on the inner-circumference side.

Figure 2B:
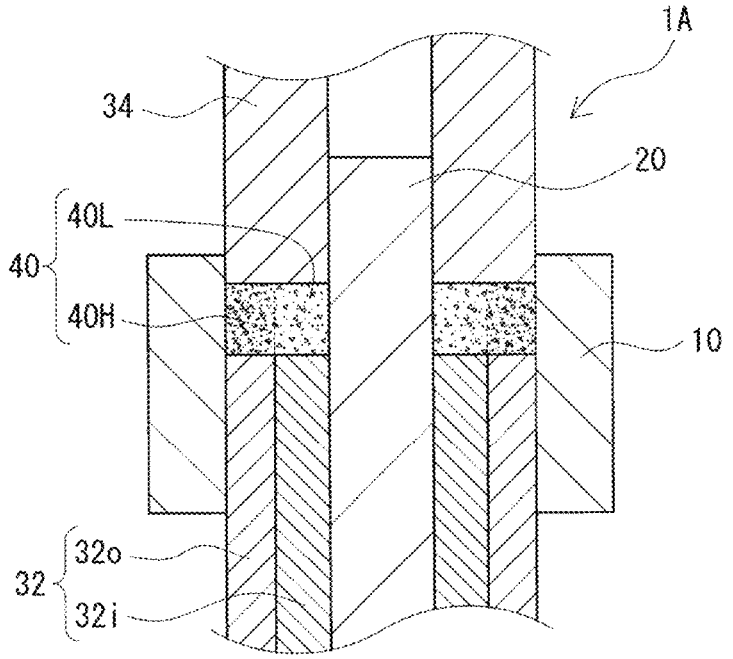
FIG. 2B is an illustrative drawing showing the state of the mold after compression in a production method according to the embodiment.

Subsequently, the two lower punches 32*i* and 32*o* are raised, and, also, the upper punch 34 is lowered. In so doing, the lower outer punch 32*o* is raised faster than the lower inner punch 32*i* such that the two lower punches 32*i* and 32*o* reach their upper limit points at the same position at the same time as illustrated in FIG. 2B. As a result, the upper end faces of the two lower punches 32*i* and 32*o* become flush with each other at the final destination position. It may be noted, however, that the upper end faces of the two lower punches 32*i* and 32*o* do not have to be flush with each other at the final destination position. Due to such compression, the raw-material powder 100 is compressed more on the outer-circumference side where the amount of injected raw-material powder 100 is relatively large, than on the inner-circumference side where the amount of injection is relatively small. A powder compact 40 of a uniform thickness is thus produced. As a result, the powder compact 40 has a high-density portion 40H formed on the outer-circumference side and a low-density portion 40L formed on the inner-circumference side, with the through hole formed at the center thereof which is to serve as a shaft hole.

From this state, the upper punch 34 is retracted upward. The two lower punches 32*i* and 32*o* are raised so that the upper end faces thereof are flush with the upper end face of the die 10. The core rod 20 is lowered so that the upper end face thereof are flush with, or lower than, the upper end face of the die 10. As a result of the noted functioning of the punches 32*i*, 32*o*, and 34 and the core rod 20, the powder compact 40 is placed on the upper end faces of the two lower punches 32*i* and 32*o* so as to be exposed on the end face of the die 10, thereby allowing easy retrieval thereof.

(Compacting Step B)

Figure 3A:
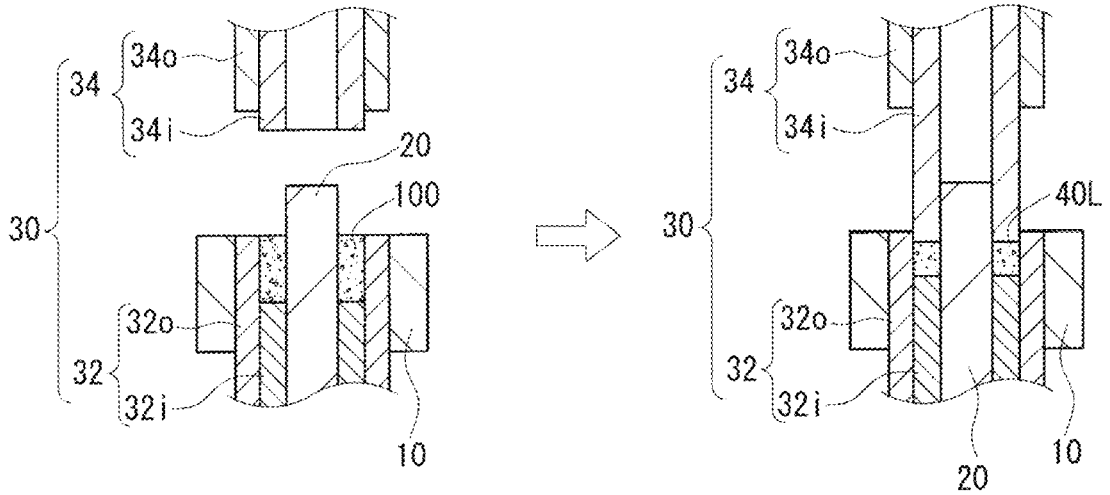
FIG. 3A is an illustrative drawing of the first half of a production method according to the embodiment.

The compacting step A uses the mold 1A having the lower punch 32 that is comprised of a pair of punches, i.e., the lower inner punch 32*i* and the lower outer punch 32*o*. The compacting step B performs a compacting process by using a mold (FIG. 3A and FIG. 3B) for which the upper punch 34 is also comprised of a pair of punches, i.e., an upper inner punch 34*i* situated on the inner-circumference side and an upper outer punch 34*o* situated on the outside thereof. The remaining configurations of the mold and the powder compact are the same as those of the compacting step A.

First, a low-density portion situated on the inner-circumference side is formed. As illustrated on the left-hand side of FIG. 3A, the upper end face of the core rod 20 is positioned above the upper end face of the die 10. With both of the upper punches 34*i* and 34*o* retracted upward, the upper end face of the lower outer punch 32*o* is made flush with the upper end face of the die 10, and the upper end face of the lower inner punch 32*i* is positioned below the upper end face of the die 10. In this state, a space surrounded by the inner circumferential surface of the lower outer punch 32*o*, the outer circumferential surface of the core rod 20, and the upper end face of the lower inner punch 32*i* serves as a cavity L for compacting the low-density portion.

Next, raw-material powder 100 is injected into the cavity L. As illustrated on the right-hand side of FIG. 3A, the lower inner punch 32*i* is raised and the upper inner punch 34*i* is lowered to compress the raw-material powder 100. This compression forms the low-density portion 40L.

Figure 3B:
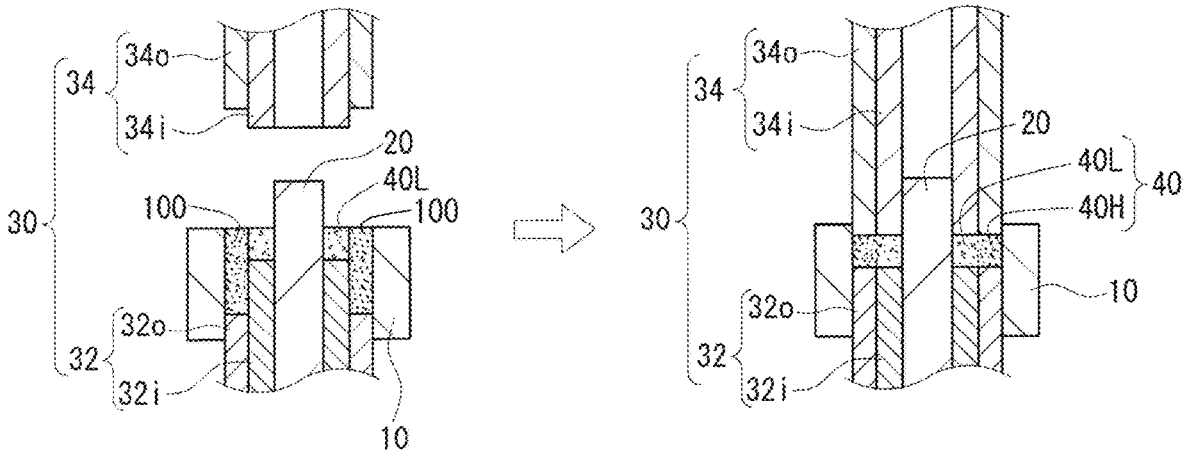
FIG. 3B is an illustrative drawing of the second half of a production method according to the embodiment.

As illustrated on the left-hand side of FIG. 3B, the lower inner punch 32*i* is raised such that the upper end face of the low-density portion placed on the upper end face thereof is flush with the upper end face of the die 10. The lower outer punch 32*o* is lowered to a certain position such that the upper end face thereof is below that of the lower inner punch 32*i* as situated prior to the compression. In this state, a space surrounded by the inner circumferential surface of the die 10, the outer circumferential surface of the low-density portion, and the upper end face of the lower outer punch 32*o* serves as a cavity H for compacting a high-density portion. Since the upper end face of the lower outer punch 32*o* is situated below the upper end face of the lower inner punch 32*i* as situated prior to the compression, the cavity H has a greater height in the axial direction than the cavity L for compacting the low-density portion.

Raw-material powder 100 is injected into the cavity H. Subsequently, as illustrated on the right-hand side of FIG. 3B, the upper outer punch 34*o* is lowered and the lower outer punch 32*o* is raised to compress the raw-material powder 100 such that the thickness (i.e., height) thereof becomes equal to that of the low-density portion 40L. This compression forms the high-density portion 40H. In so doing, the upper inner punch 34*i* and the lower inner punch 32*i* are vertically moved in conjunction with the movement of the lower outer punch 32*o* and the upper outer punch 34*o* while keeping a distance therebetween corresponding to the thickness of the low-density portion 40L. As a result of the noted functioning of the punches 32 and 34, the raw-material powder 100 inside the cavity H is compacted into a high-density portion 40H having the same thickness as the low-density portion 40L. The high-density portion 40H and the low-density portion 40L are made into a single seamless piece. The punches may be moved to expose the powder compact 40 on the end face of the die 10 similarly to the compacting step A, so that the obtained powder compact 40 may be retrieved.

The density of the high-density portion is easily made high in the compacting step B in which the low-density portion is formed first and the high-density portion is formed later, compared with the compacting step C in which the high-density portion is formed first and the low-density portion is formed later. In particular, it is preferable that the low-density portion is first formed to achieve a relative density of 60% or more, or further preferably 65% or more, followed by forming the high-density portion.

(Compacting Step C)

In the compacting step B, the low-density portion is formed first and the high-density portion is formed later, whereas in the compacting step C, the high-density portion is formed first and the low-density portion is formed later (not shown). The mold used in this compacting step is the same as the mold used in the compacting step B shown in FIG. 3A and FIG. 3B.

First, a high-density portion situated on the outer-circumference side is formed. The upper end face of the core rod is positioned above the upper end face of the die. With both of the upper punches retracted upward, the upper end face of the lower inner punch is made flush with the upper end face of the die, and the upper end face of the lower outer punch is positioned below the upper end face of the die. In this state, a space surrounded by the inner circumferential surface of the die, the outer circumferential surface of the lower inner punch, and the upper end face of the lower outer punch serves as a cavity H for compacting a high-density portion.

Next, raw-material powder is injected into the cavity H. The lower outer punch is raised and the upper outer punch is lowered to compress the raw-material powder. This compression forms a high-density portion.

The lower outer punch is raised such that the upper end face of the high-density portion placed on the upper end face thereof is flush with the upper end face of the die. The lower inner punch is lowered to a certain position such that the upper end face thereof is above that of the lower outer punch as situated prior to the compression. In this state, a space surrounded by the inner circumferential surface of the high-density portion, the outer circumferential surface of the core rod, and the upper end face of the lower inner punch serves as a cavity L for compacting a low-density portion. Since the upper end face of the lower inner punch is situated above the upper end face of the lower outer punch as situated prior to the compression, the cavity L has a smaller height in the axial direction than the cavity H for compacting the high-density portion.

Raw-material powder is injected into the cavity L, and, then, the upper inner punch is lowered and the lower inner punch is raised to compress the raw-material powder such that the thickness thereof becomes equal to that of the high-density portion. This compression forms a low-density portion. In so doing, the upper outer punch and the lower outer punch are vertically moved in conjunction with the movement of both the inner punches while keeping a distance therebetween corresponding to the thickness of the high-density portion. As a result of the noted functioning of the punches, the raw-material powder inside the cavity L is compacted into the low-density portion having the same thickness as the high-density portion. The low-density portion and the high-density portion are made into a single seamless piece. The punches may be moved to expose the powder compact on the end face of the die similarly to the compacting step A, so that the obtained powder compact may be retrieved.

(Powder Compact)

Figure 4A:
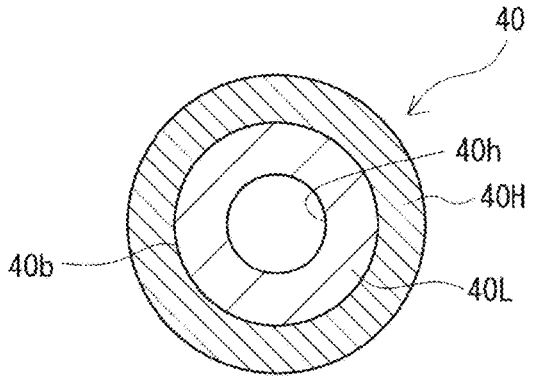
FIG. 4A is a plan view of a powder compact obtained during the production method according to the embodiment.

The powder compact 40 formed by the mold described above is supposed to have a simple shape. Examples of simple shapes include a circular cylinder, a circular tube, an elliptical cylinder, and an elliptical tube, for example. FIG. 4A illustrates the circular-tube powder compact 40. It may be noted that the faces of punches used for compressing raw-material powder may have a recess or a bulge. In such a case, the end faces of the powder compact 40 of a noted simple shape has a bulge or a recess formed therein corresponding to the noted recess or the bulge. Such a powder compact having a recess or a bulge is also considered to be a simple-shape powder compact.

This simple shape is such that the outer perimeter of the powder compact 40 as viewed in the axial direction has an arc-shaped curve, and a radius R of the curve is preferably greater than or equal to 10 mm. In other words, the inner perimeter edge of the die 10 disposed around the outer perimeter of the raw-material powder 100 has an arch-shaped curve, and the radius R of the curve is preferably greater than or equal to 10 mm. The radius R is greater than or equal to 15 mm, greater than or equal to 20 mm, and greater than or equal to 30 mm in the ascending order of preference. The powder compact and the mold having the configuration noted above can reduce the occurrence of damage to the mold 1A (FIG. 1, for example) which is caused by the concentration of excessive stress on the mold 1A during the compaction of high-density portion 40H.

(High-Density Portion and Low-Density Portion)

The powder compact 40 has the high-density portion 40H and the low-density portion 40L. The place where the high-density portion 40H is provided is preferably either one of the outer-circumference side and the inner-circumference side of the powder compact 40. The place where the low-density portion 40L is provided is preferably the other one of the outer-circumference side and the inner-circumference side of the powder compact 40. For example, if the powder compact 40 is for making an external gear, the outer-circumference side of the circular tube is made to be the high-density portion 40H, and the inner-circumference side is made to be the low-density portion 40L, as illustrated in FIG. 4A. According to need, a through hole 40*h* to serve as a shaft hole may be formed at the center of the powder compact 40. In this powder compact 40, a border 40*b* between the high-density portion 40H and the low-density portion 40L is formed in a circular shape. In the case of an internal gear, the inner-circumference side of the circular tube is made to be the high-density portion 40H, and the outer-circumference side is made to be the low-density portion 40L. The high-density portion 40H may be provided at two or more places of the powder compact 40. For example, in the case of an external gear, not only the outer-circumference side where tooth are formed, but also the periphery of the through hole 40*h* may be made to be a high-density portion. With this arrangement, the abrasion resistance of a shaft hole 44*h* (FIG. 5) can be increased upon the making of a sintered body 44.

The relative density of the high-density portion 40H of the powder compact 40 is greater than or equal to 93%. The relative density of the high-density portion 40H is preferably greater than or equal to 95%, further preferably greater than or equal to 96%, and especially preferably greater than or equal to 97%. The higher the density is, the higher the rigidity, strength, or abrasion resistance of the high-density portion 40H (44H) upon the making of the sintered body 44 (FIG. 5) is. In this manner, the sliding portions of a sintered body, such as gear tooth, are preferably made to be the high-density portion 40H. In contrast, the relative density of the low-density portion 40L of the powder compact 40 is less than 93%. The relative density of the low-density portion 40L is preferably less than or equal to 90%, and further preferably less than or equal to 88%. It may be noted that because of the need to provide a sufficient strength to the sintered body 44, 75% or more, and more preferably 85% or more, may be preferred. As the density decreases, voids upon the making of the sintered body 44 increases, and the weight of the low-density portion 40L drops. Vibration damping performance and the oil impregnating ability are thus excellent. A large difference in relative density between the high-density portion 40H and the low-density portion 40L contributes to reduction in the total weight of the powder compact 40 and thus the sintered body 44 while maintaining strength and abrasion resistance at the sliding portions. For example, the difference in relative density is preferably greater than or equal to 3%, further preferably greater than or equal to 5%, and especially preferably greater than or equal to 10%.

The relative density of the powder compact 40 may be obtained by analyzing images of observation views of the front face and the back face of the powder compact 40 along lines that equally divide the circumference into four. More specifically, images of observation views that are of an area of 300000 $\mu m^2$ (=500 μm×600 μm) are taken both near the center and near the outer perimeter on the lines that equally divide the circumference into four. Namely, images of observation views are taken at a total of 16 locations, i.e., 8 locations near the center and near the outer perimeter of the front face of the powder compact 40 and 8 locations near the center and near the outer perimeter of the back face. The obtained images of the observation views are binarized, and, then, the proportion of areas of inorganic-material powder particles, i.e., metal particles in this example, in the total area of an observation view is obtained. This area proportion is regarded as the relative density of the observation view. The relative densities of the center-side observation views are averaged over the front face and the back face to produce a relative density on the inner-circumference side. The relative densities of the outer-perimeter-side observation views are averaged over the front face and the back face to produce a relative density on the outer-circumference side. Normally, one of the inner-circumference side and the outer-circumference side of the powder compact 40 is the high-density portion 40H, and the other one is the low-density portion 40L. Accordingly, one of the relative density of the inner-circumference side and the relative density of the outer-circumference side becomes the relative density of the high-density portion 40H, and the other one becomes the relative density of the low-density portion 40L. The powder compact 40 obtained by the compacting step A, for example, has the high-density portion 40H on the outer-circumference side and the low-density portion 40L on the inner-circumference side. The relative density of the outer-circumference side thus becomes the relative density of the high-density portion 40H, and the relative density of the inner-circumference side becomes the relative density of the low-density portion 40L. It may be noted that the distinction between the high-density portion 40H and the low-density portion 40L is relatively easy to make based on the relative numbers of voids in the observation views.

The thickness of the high-density portion 40H, i.e., the dimension of the high-density portion 40H in the radial direction, is preferably set such that the portions to serve as the sliding portions upon the making of the sintered body 44 can be formed therein. For example, in the case of making a gear based on the sintered body 44, the high-density portion 40H needs to have a thickness greater than or equal to the whole depth of teeth. Especially in the case of an external gear (or internal gear), forming the high-density portion 40H having a predetermined thickness from the bottom land toward the center (or toward the outer perimeter) requires that the thickness of the high-density portion 40H is greater than or equal to about "Whole Depth+0.5 mm", and more preferably greater than or equal to about "Whole Depth+1.0 mm".

(Compacting Pressure)

Pressure (surface pressure) at the time of compaction may be greater than or equal to 600 MPa. An increase in surface pressure can increase the relative density of a powder compact. Preferred surface pressure is greater than or equal to 1000 MPa. More preferred surface pressure is greater than or equal to 1500 MPa. Further preferred surface pressure is greater than or equal to 2000 MPa. There is no particular upper limit of surface pressure as long as no damage is caused to the mold.

[External Lubricant]

During compaction, an external lubricant is preferably applied to the inner circumferential surface of a mold (i.e., the inner circumferential surface of a die and also the pressing faces of punches) in order to prevent powder of inorganic material, especially metal powder, from being stuck on the mold. A metallic soap or the like such as lithium stearate, zinc stearate, or the like, for example, may be used as the external lubricant. Alternatively, a fatty acid amide such as lauric acid amide, stearic acid amide, or palmitic acid amide, or a higher fatty acid amide such as ethylene bistearic acid amide may be utilized as the external lubricant.

<<S3. Machining Step>>

Figure 4B:
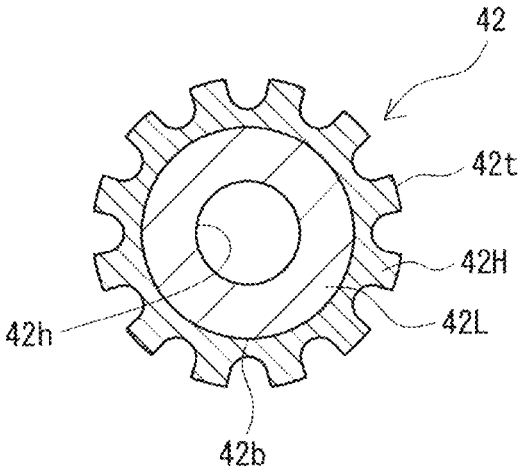
FIG. 4B is a plan view of a machined compacted part obtained during the production method according to the embodiment.

In the machining step, a machining process is applied to the powder compact 40, without performing sintering upon making the powder compact 40. This machining process produces a machined compacted part 42 having a near net shape to the sintered body 44. FIG. 4B illustrates an example of the machined compacted part 42. This machined compacted part 42 has teeth 42*t* formed in a high-density portion 42H on the outer circumference, and the high-density portion 42H extends up to a predetermined position closer to the center than the bottom land. An annular low-density portion 42L is provided on the inner side of the high-density portion 42H. Further, a through hole 42*h* is provided on the inner side of the low-density portion 42L. In other words, the low-density portion 42L and the high-density portion 42H are concentrically disposed, with the border 42*b* between the two portions 42L and 42H being a circle.

Figure 5:
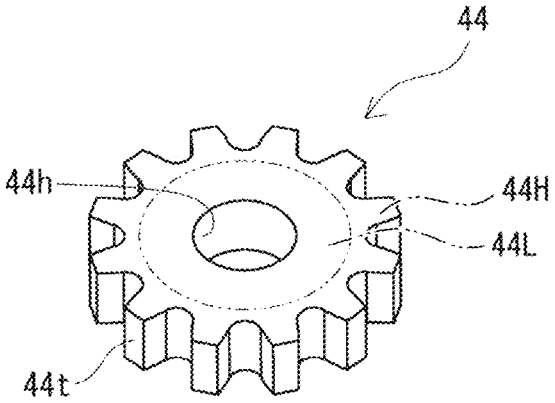
FIG. 5 is an axonometric view of a sintered body made by the production method according to the embodiment.

The powder compact 40 is not such that individual particles constituting the raw-material powder 100 are strongly bonded together as in the case of the sintered body 44 (FIG. 5). Because of this, machining of the powder compact 40 involves significantly lower machining load than the machining of the sintered body 44, which allows high-speed, efficient machining. In particular, even a shape having highly twisted curved surfaces such as the teeth of a helical gear can be relatively easy to machine when the machining process is applied to the powder compact 40. A machining process is preferably applied to the high-density portion 40H. The high-density portion 40H is normally the portions that are to become the sliding portions upon sintering. The high-density portion 40H may be machined to predetermined shapes required of the sliding portions such as gear teeth, which allows the sintered body 44 to have high-density sliding portions in final form. Needless to say, a machining process may be applied to the low-density portion 40L.

Each machining process is mainly a cutting process, in which a tool for cutting is used to form the powder compact 40 into a predetermined shape. Examples of cutting processes include rolling and turning. Rolling includes drilling. The cutting tool may be a drill and a reamer in the case of drilling, a milling machine and an end mill in the case of rolling, as well as a shank and an exchangeable turning insert in the case of turning. In addition, a hob, a broach, a pinion cutter, and the like may be used to perform a cutting process. A machining center that enables a plurality of types of automatic machining may be used to perform machining processes. In addition, cutting may be performed as machining.

The powder compact 40 made by compacting powder of inorganic material is machined such that inorganic-material particles are removed by cutting or the like from the surface of the powder compact 40. As a result, process dust generated by machining processes is powder comprised of inorganic-material particles separated from the powder compact 40. Process dust in powder form can be reused without being melted. Any particle chunks of consolidated inorganic-material particles such as metal particles contained in the process dust may be pulverized according to need. In contrast, a solid body such as the sintered body 44 in which metal particles are bonded together is machined such as to scrape the surface of the solid body by use of a cutting tool or the like. Process dust generated by machining is thus a piece of a strip having a certain length, and cannot be reused unless melted.

A volatile solution or plastic solution made by melting an organic binder may be applied to or permeated into the surface of the powder compact 40 prior to machining, thereby preventing a crack or a chip in the surface of the powder compact 40 during the machining process.

Further, the machining process may be performed while applying compressive stress to the powder compact 40 to reduce the occurrence of a crack or a chip in the powder compact 40. This compressive stress is applied in such a direction as to cancel the tension stress applied to the powder compact 40. This tension stress is applied in the direction in which the cutting tool exits from the powder compact 40. In the case of broaching that forms a hole through the powder compact 40, strong tension stress is applied to around the exit of the processed hole when a broach penetrates the powder compact 40. A method of applying compressive stress to the powder compact 40 to cancel this tension stress includes stacking a plurality of powder compacts 40 one over another. A dummy powder compact 40 or a plate member may be arranged under the bottommost one of the powder compacts 40. Stacking the powder compacts 40 one over another causes the bottom surface of a powder compact 40 on an upper stage to be held up by the top surface of a powder compact 40 on a lower stage, which serves to apply compressive stress to the bottom surface. When broaching is performed to the stack of powder compacts 40 from the upper side thereof, a crack or a chip can effectively be prevented at or around the exit of a processed hole formed at the bottom surface of the powder compacts 40. In the case of a milling machine being used to form a groove into the powder compact 40, strong tension stress is applied to around the exit of the processed groove. As a countermeasure configuration, a plurality of powder compacts 40 may be arranged in the direction in which the milling machine advances, such that compressive stress is applied to the exit of processed grooves.

<<S4. Sintering Step>>

In the sintering step, the machined compacted part 42 obtained by applying a machining process to the powder compact 40 is sintered. Sintering the machined compacted part 42 generates the sintered body 44 (FIG. 5) in which particles of inorganic-material powder, i.e., metal powder in particular, are bonded together in contact with each other. In sintering the machined compacted part 42, known conditions may be applied in accordance with the composition of inorganic-material powder. For example, for the metal powder that is iron powder or iron alloy powder, the sintering temperature may be greater than or equal to 1100° C. and less than or equal to 1400° C., and preferably greater than or equal to 1200° C. and less than or equal to 1300° C. The sintering time may be greater than or equal to 15 minutes and less than or equal to 150 minutes, and further preferably greater than or equal to 20 minutes and less than or equal to 60 minutes, for example.

The extent of machining during the machining process may be adjusted based on differences between the actual dimensions and the designed dimensions of the sintered body 44. The machined compacted part 42 shrinks almost evenly upon sintering. The extent of machining during the machining process may be adjusted based on differences between actual sintered dimensions and designed dimensions, thereby making it possible to bring the actual dimensions of the sintered body 44 significantly close to the designed dimensions. As a result, the labor and time required for a subsequent finish machining can be reduced. Use of a machining center during the machining process allows easy adjustment of the extent of machining.

<<S5. Finishing Step>>

In the finishing process, sizing is performed, and a grinding process or the like is applied to the surface of the sintered body 44 to reduce the surface coarseness of the sintered body 44 and also to make the dimensions of the sintered body 44 match with the designed dimensions. This finishing process is also expected to crush voids in the finished surface and to increase the abrasion resistance of the sintered body 44. An example of an external gear having undergone the finishing step is illustrated in FIG. 5. The external gear having the low-density portion 44L on the inner-circumference side and the high-density portion 44H on the outer-circumference side is obtained. In FIG. 5, the boundary between the low-density portion 44L and the high-density portion 44H is shown in a dash-and-two-dot line.

<<Outline of Sintered Body>>

According to the method of making a sintered body as described heretofore, the sintered body 44 having the high-density portion 44H and the low-density portion 44L can be obtained. The relative densities of the portions 44H and 44L of the sintered body 44 are substantially equal to the relative densities of the respective portions 40H and 40L of the powder compact 40 prior to sintering. In other words, the relative density of the high-density portion 44H of the sintered body 44 is greater than or equal to 93%, preferably greater than or equal to 95%, more preferably greater than or equal to 96%, and further preferably greater than or equal to 97%. The higher the relative density of the high-density portion 44H is, the higher the strength of the sintered body 44 is. Further, the relative density of the low-density portion 44L of the sintered body 44 is preferably less than 93%, more preferably less than or equal to 90%, and further preferably less than or equal to 88%. It may be noted that because of the need to provide a sufficient strength to the sintered body 44, the relative density of the low-density portion 44L is preferably greater than or equal to 75% and further preferably greater than or equal to 85%.

The relative density of the sintered body 44 can be obtained similarly to the relative density of the powder compact 40. It may be obtained by analyzing images of observation views of the front face and the back face of the sintered body 44 along lines that equally divide the circumference into four. More specifically, images of observation views that are of an area of 300000 $\mu m^2$ (=500 μm×600 μm) are taken both near the center and near the outer perimeter on the lines that equally divide the circumference into four. Namely, images of observation views are taken at a total of 16 locations, i.e., 8 locations near the center and near the outer perimeter of the front face of the sintered body 44 and 8 locations near the center and near the outer perimeter of the back face. The obtained images of the observation views are binarized, and, then, the proportion of areas of inorganic-material powder particles in the total area of an observation view is obtained. This area proportion is regarded as the relative density of the observation view. The relative densities of the center-side observation views are averaged over the front face and the back face to produce a relative density on the inner-circumference side. The relative densities of the outer-perimeter-side observation views are averaged over the front face and the back face to produce a relative density on the outer-circumference side. Normally, one of the inner-circumference side and the outer-circumference side of the sintered body 44 is the high-density portion, and the other one is the low-density portion. Accordingly, one of the relative density of the inner-circumference side and the relative density of the outer-circumference side of the sintered body 44 becomes the relative density of the high-density portion, and the other one becomes the relative density of the low-density portion.

<<Effect>>

According to the method of making a sintered body, a sintered body that has different density portions can efficiently be made without damaging a mold for compacting a sintered body. For example, a mold is easily damaged when compacting a powder compact having a near net shape to a sintered body, and, also, a significant increase in the capacity of compression is needed in order to make the entirety of the powder compact into a high-density portion by use of an existing press machine. In contrast, the maximum stress ratio of the shape surrounded by the perimeter of a cavity in a cross-section of the mold may be made less than or equal to 2.6, thereby reducing the concentration of stress to the mold. With this arrangement, damage to the mold can be reduced. In particular, the shape of a powder compact may be made into a simple shape such as a circular cylinder or a circular tube to reduce damage to the mold. Further, the place of the high-density portion may be provided only in a portion of the powder compact, i.e., in a portion of a cross-section perpendicular to the direction of compression. This serves to increase pressure applied per unit area with respect to the place of the high-density portion. Namely, the compression capacity of an existing press machine can be utilized to compact the high-density portion. In this manner, the high-density portion is formed during the stage of a powder compact, and the high-density portion is not formed by applying pressure to a sintered body. This makes it easy to avoid an excessive increase in the applied pressure.

In particular, the high-density portion is provided in the portion of a complex shape that functions as a sliding portion upon the making of a sintered body, which makes it possible to produce a sintered body having excellent mechanical characteristics. In such a case, a mechanical process is applied to the high-density portion of a powder compact. Even in the case of machining a high-density portion, the machining load is significantly lower with respect to a powder compact than with respect to a sintered body, which allows a complex shape to be efficiently provided to the powder compact.

The sintered body obtained by the method of making a sintered body described heretofore has the low-density portion in addition to the high-density portion, so that weight reduction is achieved, compared with the case in which the entirety thereof is comprised of the high-density portion.

<Example of Production>

In examples of production, the external gear illustrated in FIG. 5 is made by the method of making a sintered body according to the embodiment or by a conventional method of making a sintered body. This external gear is a spur gear.

First, raw-material powder was prepared by mixing C (graphite) powder of 0.3 mass % into an alloy powder of Fe-2 mass % Ni-0.5 mass % Mo. The average diameter of the alloy powder is 100 μm. The true density of the raw-material powder is 7.8 g/$cm^3$. No lubricant is contained in the raw-material powder.

Next, the raw-material powder was compacted to make a flat cylindrical-tube powder compact having the following dimensions. The maximum stress ratio at the inner perimeter of a mold (die) used for compacting the raw-material powder is 1.0, and the diameter of an arc constituting the inner perimeter is 98 mm, with the radius being 49 mm.

Outer Diameter: 98 mmϕ

Inner Diameter: 30 mmϕ

Thickness: 15 mm

The powder compact of sample A was formed such that, with a circumference of 80 mmϕ serving as a boundary, the inside of the boundary was low density, and the outside of the boundary was high density.

The powder compact of sample B was formed by using a mold having a single upper punch and a single lower punch, such as to have a uniform density over the entire area.

For each sample, the amount (g) of raw material used for generating a powder compact was calculated.

Then, a commercially available machining center was used to apply a machining process to created powder compacts to produce machined compacted parts each having a near net shape to the designed dimensions. Each machined compacted part is an external gear which has a module of 1.4 and for which the whole depth of teeth is 3.1 mm, and the number of teeth is 67. The machining process of the powder compacts did not create any crack or chip to the powder compacts. Process dust generated by the machining process was metal powder comprised of particles separated from the powder compacts.

With respect to the machined compacted parts of sample A and sample B, the cubic volume, density, and mass of each machined compacted part were obtained, and the ratio of amounts of raw-material powder used was obtained in the case in which the amount of raw-material powder of sample B was regarded as being 100%. With a circumference of 80 mmϕ serving as a boundary in a powder compact, bulk density and relative density were obtained for both the inner side and the outer side of the boundary, and these values were treated as the bulk density and relative density of the machined compacted part. Relative density was obtained as previously described by analyzing images of observation views at 16 locations each of which has an area of 300000 $\mu m^2$ or more. In the case of sample B, the entire area has a substantially uniform density, so that both the bulk density and the relative density are identical between the inner side and the outer side. Table 1 illustrates the results of measurement. In Table 1, a circumference of 80 mmϕ is used as a boundary to denote the inside of the boundary as "INNER SIDE" and to denote the outside of the boundary as "OUTER SIDE". It may be noted that the cubic volume of a machined compacted part is smaller than the cubic volume of a powder compact, and the total mass of each sample is smaller than the amount of raw-material powder used. This is because part of a powder compact is removed by machining when the powder compact is made into a machined compacted part.

TABLE 1

| | PORTION | | SAMPLE A | SAMPLE B |
|---|---|---|---|---|
| CUBIC VOLUME | INNER SIDE ($cm^3$) | | 31.1 | 31.1 |
| | OUTER SIDE ($cm^3$) | | 64.8 | 64.8 |
| DENSITY | INNER SIDE | BULK DENSITY ($g/cm^3$) | 6.0 | 7.7 |
| | | RELATIVE DENSITY (%) | 76.9 | 98.7 |
| | OUTER SIDE | BULK DENSITY ($g/cm^3$) | 7.7 | 7.7 |
| | | RELATIVE DENSITY (%) | 98.7 | 98.7 |
| MASS | INNER SIDE (g) | | 389 | 499 |
| | OUTER SIDE (g) | | 240 | 240 |
| | TOTAL (g) | | 629 | 739 |
| RAW MATERIAL | AMOUNT USED (g) | | 679 | 790 |
| | RATIO (%) | | 86 | 100 |

Subsequently, the machined compacted parts were each sintered to make an external gear made of a sintered body. Sintering was performed in nitrogen atmosphere at 1100° C. Neither a crack nor a chip was created in the sintered body during the sintering process. At the end, grinding and the like were performed to bring the dimensions of the external gear closer to the designed dimensions and also to reduce surface coarseness.

As is clearly seen from the results shown in FIG. 1, the powder compact of sample A is successfully made such that the inner side is low density and the outer side is high density. Upon making a sintered body, thus, the outer area serving as teeth is made in high density, which is believed to provide high rigidity and excellent abrasion resistance. The difference in relative density between the inner side and the outer side of sample A is greater than or equal to 20%. Further, as can be seen, the amount of raw-material powder used for sample A is reduced by approximately 15%, compared with that of sample B. As a result, as can be seen, the mass of the sintered body which is substantially the same as the mass of the machined compacted part is also reduced by greater than or equal to 10%, and specifically by about 15%.

<Example of Calculation>

Figure 6:
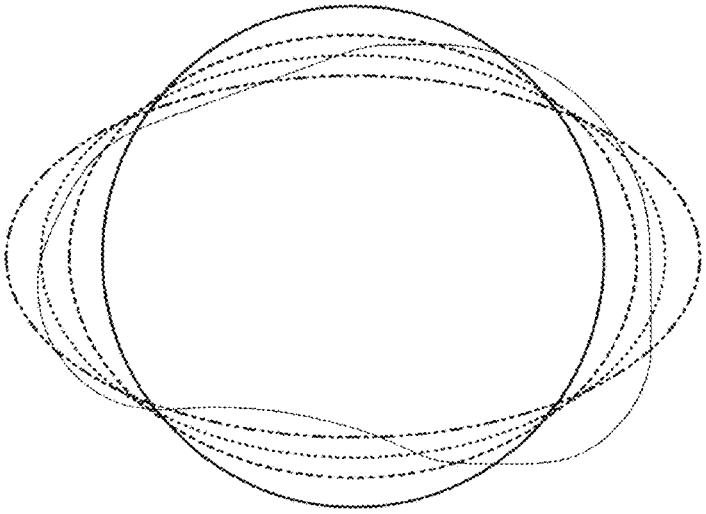
FIG. 6 is an illustrative drawing showing the shape of an inner perimeter surface of a mold with respect to samples No. 1 through No. 5.
Figure 7:
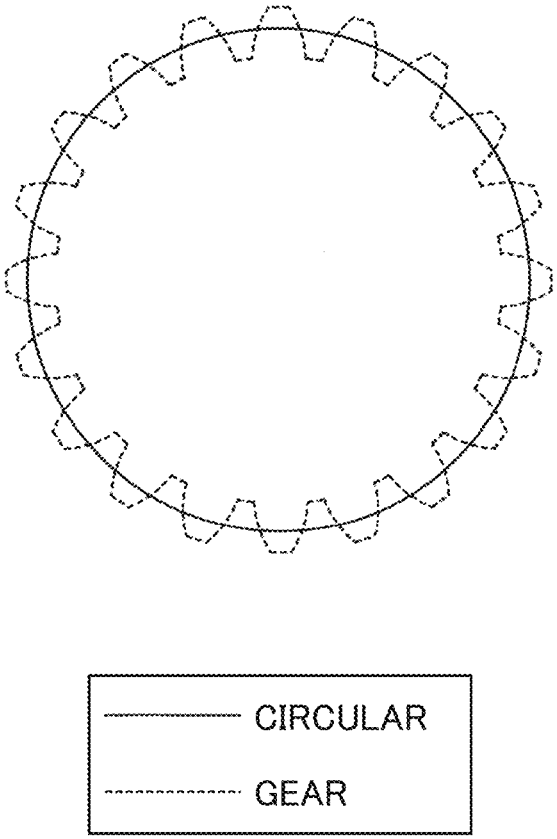
FIG. 7 is an illustrative drawing showing the shape of an inner perimeter surface of a mold with respect to samples No. 1 and No. 6.

Different cavity shapes were used to estimate stress applied to the inner perimeter of a mold when raw-material powder inside the cavity is compacted. NX Nastran was used as stress analysis software in this analysis. The shape of a cavity perimeter in a cross-section of a mold is circular for sample No. 1, elliptical for sample No. 2 through sample No. 4, a deformed oval variant for sample No. 5, and a gear shape (with the number of teeth being 20) for sample No. 6. The cavity perimeter shapes of sample No. 1 through sample No. 5 are shown overlaid with each other in FIG. 6. The cavity perimeter shape of sample No. 6 is shown overlaid with the cavity perimeter shape of sample No. 1 in FIG. 7. Molds having these perimeter shapes are used to perform the above-noted analysis by assuming that the upper and lower punches compress raw-material powder with a compression force of 1961 MPa (20 $t/cm^2$), and that 0.8 times as high pressure as this pressure is applied to the cavity perimeter.

The areas of regions surrounded by the cavity perimeters are all identical. Table 2 illustrates the conditions for estimation, and Table 3 illustrates the results of estimation. In Table 2, "AREA" is the area of a cavity in a cross-section of a mold. "SHORT RADIUS" and "LONG RADIUS" refer to half the minimum length and half the maximum length, respectively, of the area surrounded by a cavity perimeter in a cross-section of a mold. The short radius and long radius of sample No. 1 for which the shape of a cross-section of the cavity is circular are each the radius of a circle. The short radius and long radius of samples No. 2 through No. 4 for which the shape of a cross-section of the cavity is elliptical are the short radius and long radius of an ellipse, respectively. In the case of sample No. 6 having a gear shape, the radius of the dedendum circle of a powder compact is shown as the short radius, and the radius of the addendum circle is shown as the long radius. "LONG/SHORT RATIO" is the ratio calculated as LONG RADIUS/SHORT RADIUS. In Table 3, "σmax" is the maximum stress applied to the inner perimeter of a mold. "MAXIMUM STRESS RATIO" is a ratio of maximum stress to imaginary maximum stress that is observed when an imaginary mold having a shape surrounded by the perimeter of a cavity is used. "CORNER R of σmax PORTION" is the radius of an arc that constitutes the portion at which the maximum stress occurs on the inner perimeter surface of a mold. "RESULT OF COMPACTION" indicates whether a relative density of 93% or more has been successfully formed. G indicates successful compaction, and B indicates failed compaction.

The results of estimation for samples No. 1 through No. 6 are shown in FIG. 8 through FIG. 13B. Numerical values in FIG. 8 through FIG. 13B are shown in units of MPa. With respect to the cavity perimeter, the X direction is defined as 0 degrees, and the distribution of stress applied to the perimeter is shown along the counterclockwise direction in the graph of FIG. 14. Further, the relationship between the long/short ratio and the maximum stress ratio is shown in the graph of FIG. 15 with respect to sample No. 1 through sample No. 5.

TABLE 2

| SAMPLE No. | NAME ASSIGNED | AREA ($mm^2$) | SHORT RADIUS (mm) | LONG RADIUS (mm) | LONG RADIUS/ SHORT RADIUS RATIO |
|---|---|---|---|---|---|
| 1 | CIRCLE | 3049.65 | 31.16 | 31.16 | 1.00 |
| 2 | ELLIPSE 1.28 | 3049.65 | 27.50 | 35.30 | 1.28 |
| 3 | ELLIPSE 1.55 | 3049.65 | 25.00 | 38.83 | 1.55 |
| 4 | ELLIPSE 1.92 | 3049.65 | 22.50 | 43.14 | 1.92 |
| 5 | VARIANT | 3049.65 | 25.80 | 37.99 | 1.47 |
| 6 | GEAR | 3049.65 | 27.675 | 33.8 | — |

TABLE 3

| SAMPLE No. | NAME ASSIGNED | σ max (MPa) | MAXIMUM STRESS RATIO | CORNER R OF σ max PORTION (mm) | RESULT OF COMPACTION |
|---|---|---|---|---|---|
| 1 | CIRCLE | 1122 | 1.00 | 31.1 | G |
| 2 | ELLIPSE 1.28 | 1653 | 1.47 | 21.82 | G |
| 3 | ELLIPSE 1.55 | 2134 | 1.90 | 16.4 | G |
| 4 | ELLIPSE 1.92 | 2725 | 2.43 | 11.97 | G |
| 5 | VARIANT | 2406 | 2.14 | 15 | G |
| 6 | GEAR | 3210 | 2.86 | 0.65 | B |

As shown in Table 2 and Table 3, the maximum stress σmax applied to the inner perimeter of a mold is small when the maximum stress ratio is less than or equal to 2.6, preferably less than or equal to 2.5, and further preferably less than or equal to 2.0, in which case a high-density powder compact can be formed. Further, as can be seen, the larger the corner R of the σmax portion is, the smaller the maximum stress σmax is. In particular, when the corner R of the σmax portion is greater than or equal to 10 mm and specifically greater than or equal to 20 mm, the maximum stress σmax is small. Further, as can be seen, a long/short ratio of 2.0 or less allows the formation of a high-density powder compact when the shape of a cavity perimeter is elliptical.

Figure 8:
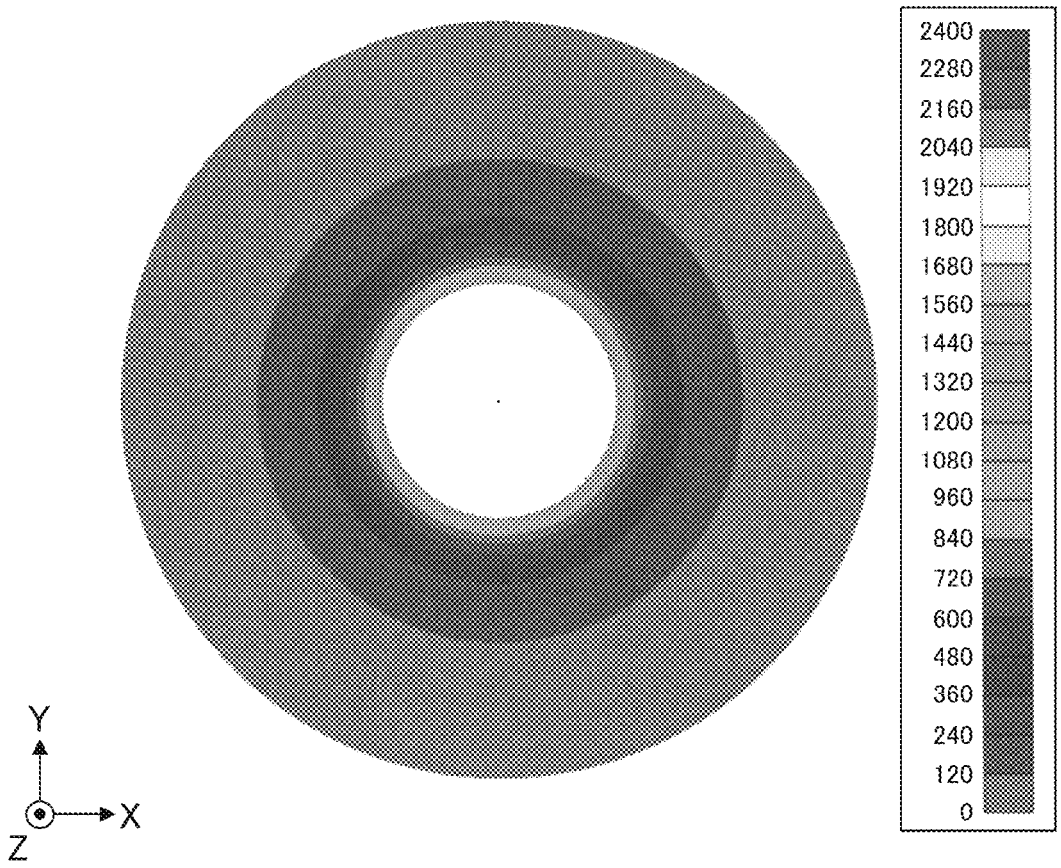
FIG. 8 is a graph of a stress distribution in the mold of sample No. 1.
Figure 9:
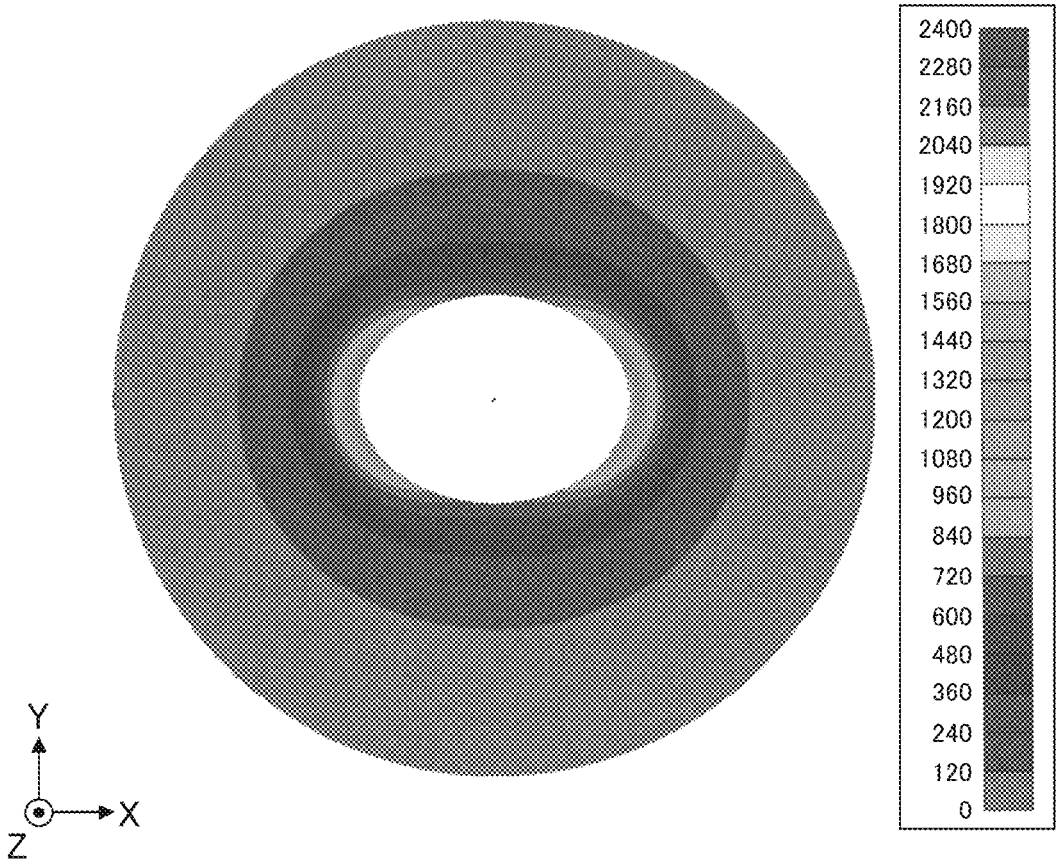
FIG. 9 is a graph of a stress distribution in the mold of sample No. 2.
Figure 10:
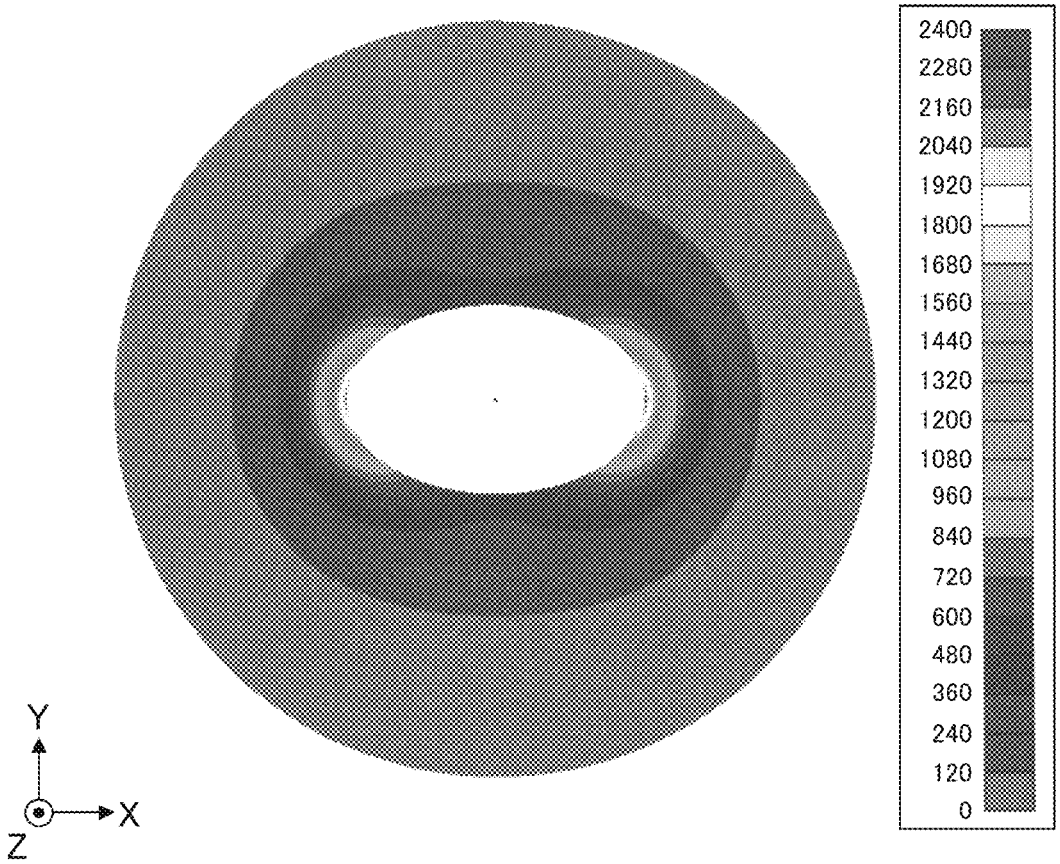
FIG. 10 is a graph of a stress distribution in the mold of sample No. 3.
Figure 11:
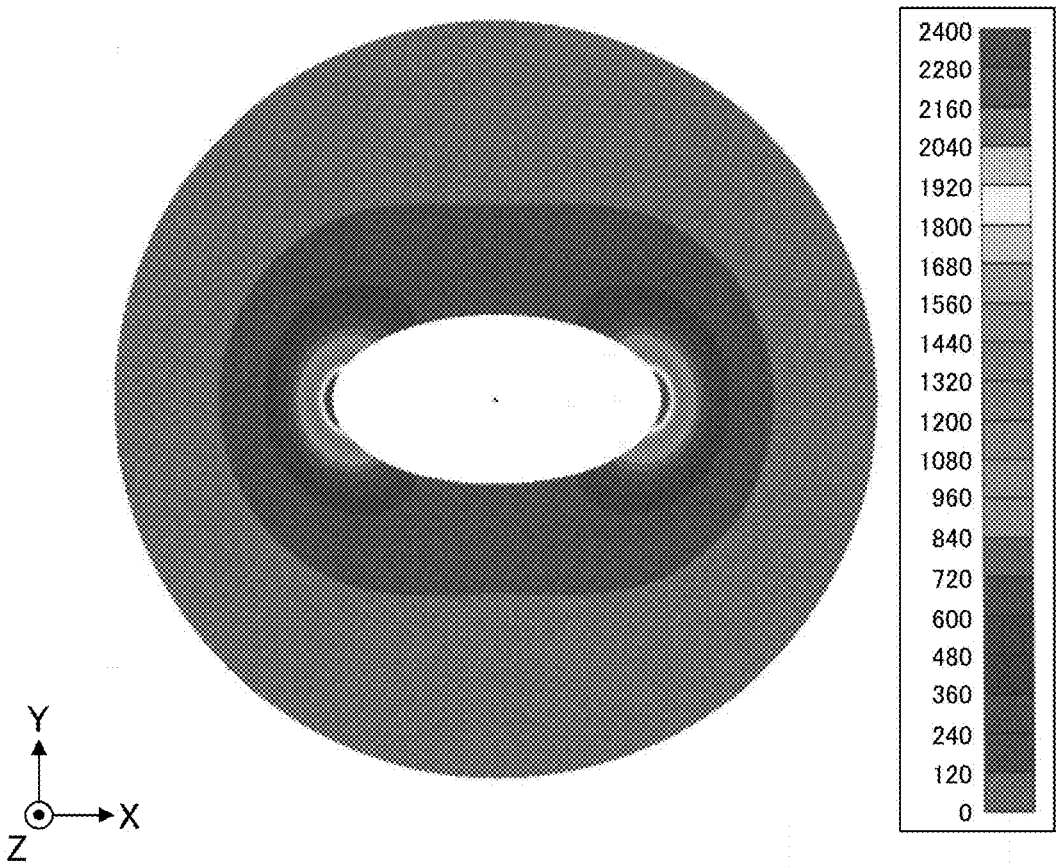
FIG. 11 is a graph of a stress distribution in the mold of sample No. 4.
Figure 12:
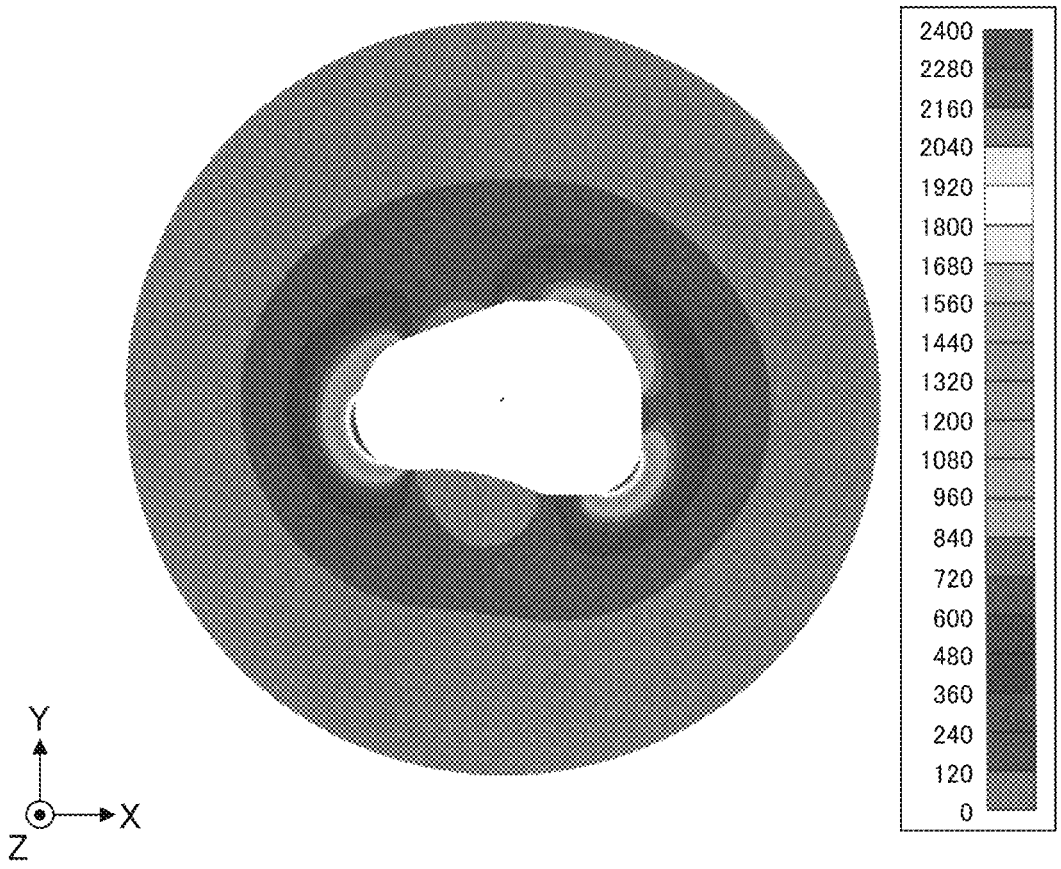
FIG. 12 is a graph of a stress distribution in the mold of sample No. 5.
Figure 13A:
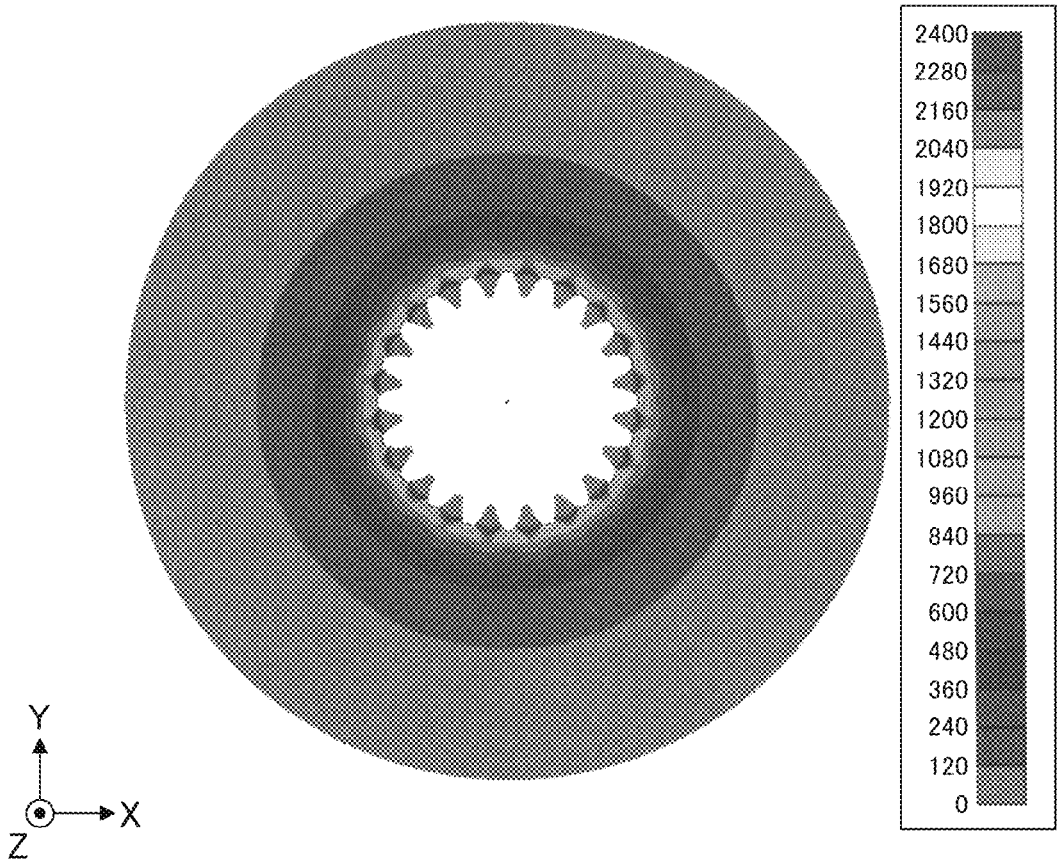
FIG. 13A is a graph of a stress distribution in the mold of sample No. 6.
Figure 13B:
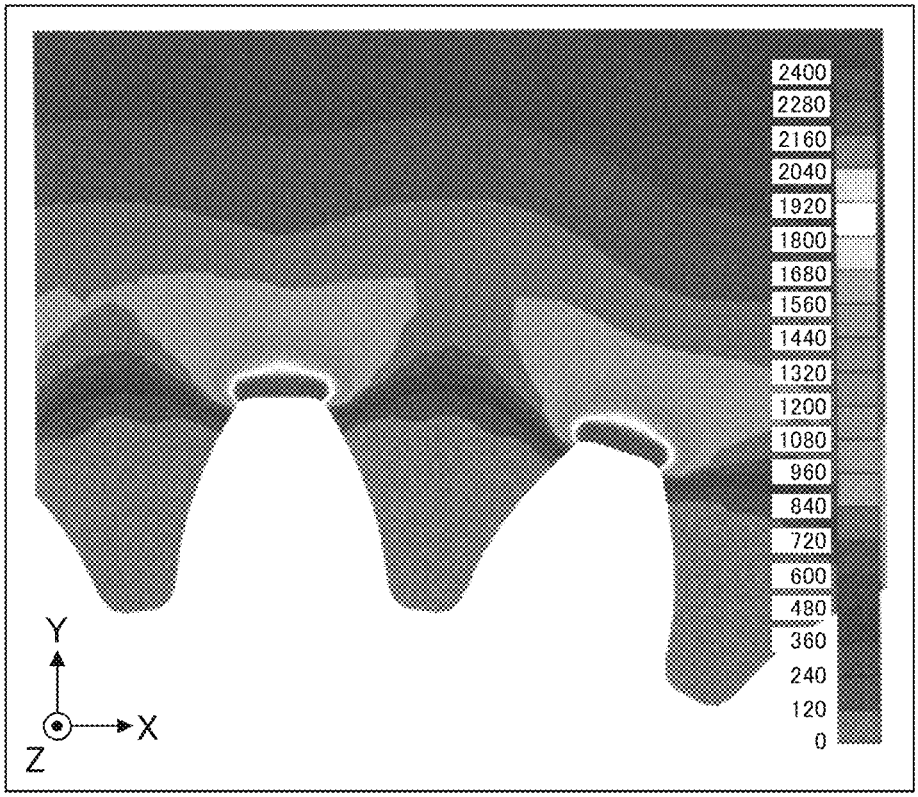
FIG. 13B is an enlarged view of a portion of FIG. 13A.

As shown in FIG. 8, sample No. 1 for which the cavity perimeter is circular receives the highest stress at the inner perimeter thereof, but the stress is evenly distributed along the circumferential direction. As shown in FIG. 9 through FIG. 11, samples No. 2 through No. 4 for which the cavity perimeter is elliptical receive the maximum stress at the places corresponding to the long axis of the ellipse. Further, as can be seen, the larger the long/short ratio is, the greater the maximum stress is. As shown in FIG. 12, sample No. 5 for which the cavity perimeter is a variant has an uneven distribution of stress along the cavity perimeter. As shown in FIG. 13A and FIG. 13B, sample No. 6 for which the cavity perimeter is a gear shape has the concentration of stress at the portions corresponding to the tooth tips of a powder compact, i.e., the bottoms of recesses in the inner perimeter of a mold.

Figure 14:
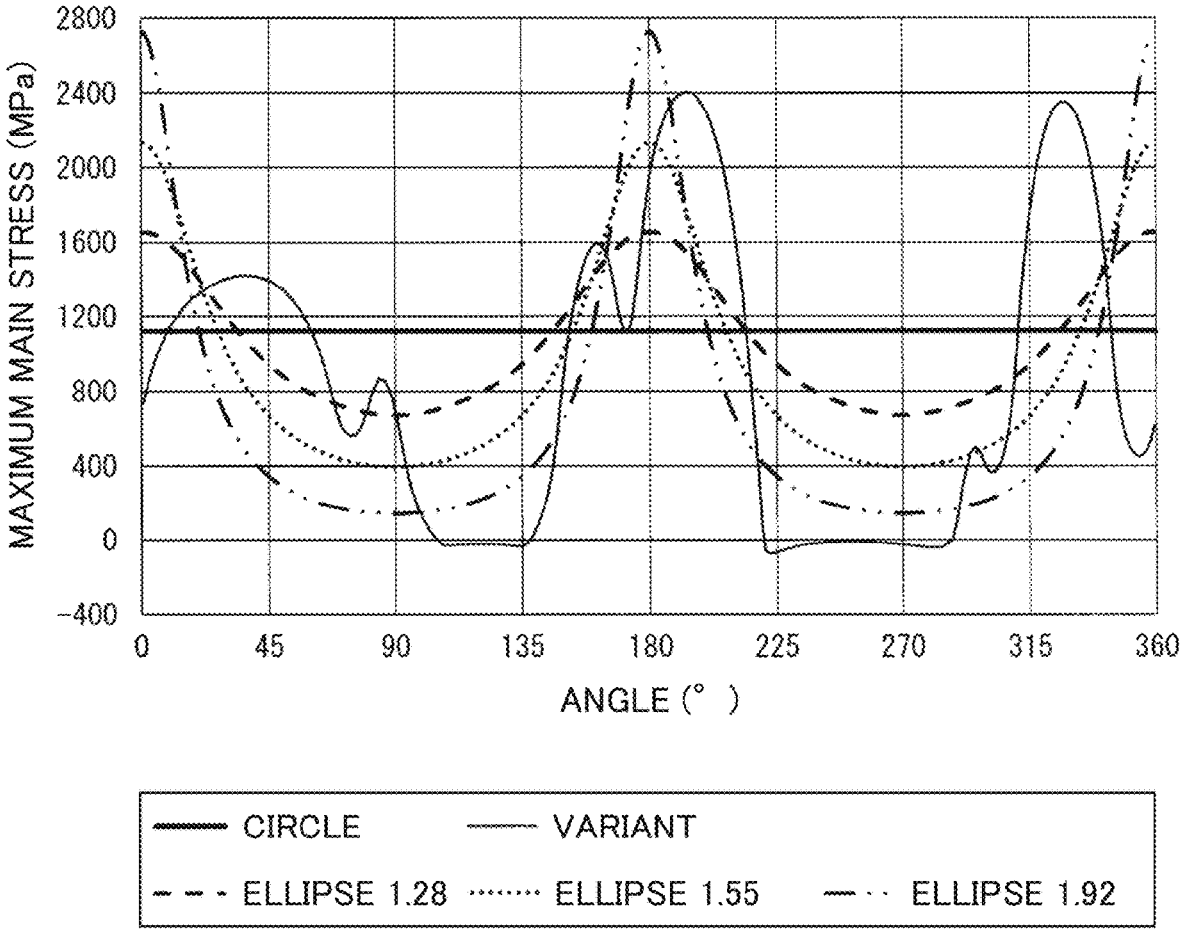
FIG. 14 is a graph of stress distributions along the circumferential direction of the molds of samples No. 1 through No. 5.
Figure 15:
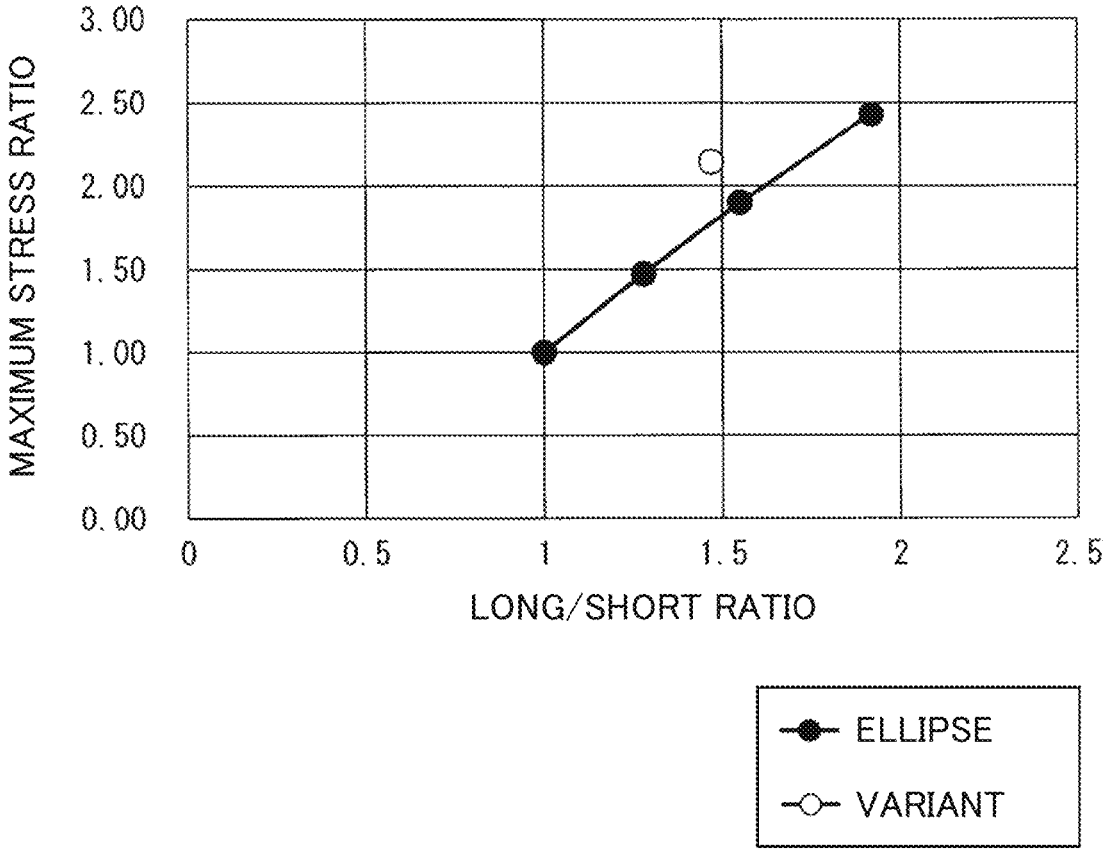
FIG. 15 is a graph of the relationship between the long/short ratio and the maximum stress ratio of a mold.

As shown in and as can be seen from FIG. 14, the distribution of stress along a cavity perimeter is even in the case of a circular shape, and exhibits periodic changes in accordance with the positions of the long axis and the short axis in the case of an elliptical shape. In the case of a variant, the distribution is irregular in accordance with the shape thereof.

As shown in and as can be seen from FIG. 15, the relationship between the long/short ratio of a cavity perimeter and the maximum stress ratio is generally direct proportion in the case of a circle and ellipses. Further, as can be seen, the long/short ratio is less than or equal to 2.0 when the maximum stress ratio is less than or equal to 2.6.

DESCRIPTION OF REFERENCE SYMBOLS

1A mold
10 die
12 die hole
20 core rod
30 punch
32 lower punch
32*o* lower outer punch
32*i* lower inner punch
34 upper punch
34*o* upper outer punch
34*i* upper inner punch
40 powder compact
40H high-density portion
40L low-density portion
40*h* through-hole
40*b* boundary
42 machined compacted part
42H high-density portion
42L low-density portion
42*h* through-hole
42*b* boundary
42*t* tooth
44 sintered body
44H high-density portion
44L low-density portion
44*h* shaft hole
100 raw material powder

The invention claimed is:

1. A method of making a sintered body, comprising:

a step of preparing raw material powder containing powder of inorganic material;

a step of producing a powder compact having a high-density portion with a relative density of 95% or more and a low-density portion with a relative density of less than 93%, with a difference in relative density between the high-density portion and the low-density portion being 3% or more, by compressing the raw material powder injected into a mold;

a step of producing a machined compacted part by machining at least the high-density portion of the powder compact; and a step of sintering the machined compacted part to make a sintered body, wherein a perimeter shape of a cavity constituted by the mold in a cross-section perpendicular to an axial direction of the mold is such than a maximum stress applied to an inner perimeter surface of the mold during a compacting process using the mold is less than or equal to 2.6 times an imaginary maximum stress that is applied to an inner perimeter surface of an imaginary mold during a compacting process using the imaginary mold, the imaginary mold having an imaginary cavity that has a same area as the cavity and that has a circular perimeter shape.

2. The method of making a sintered body as claimed in claim 1, wherein the inorganic material contains at least one of an iron-based metal and a non-iron metal.

3. The method of making a sintered body as claimed in claim 1, wherein the powder compact has an annular shape with an inner circumference and an outer circumference, and wherein the high-density portion is situated on one of a same side as the inner circumference and a same side as the outer circumference, and the low-density portion is situated on another one of the same side as the inner circumference and the same side as the outer circumference.

4. The method of making a sintered body as claimed in claim 1, wherein a shape of the powder compact is a circular cylinder, a circular tube, an elliptical cylinder, or an elliptical tube.

5. The method of making a sintered body as claimed in claim 1, wherein the mold includes a die disposed around an outer perimeter of the raw-material powder, and the inner perimeter of the die has an arc-shaped curve, wherein a minimum radius R of the curve is greater than or equal to 10 mm.

6. The method of making a sintered body as claimed in claim 1, wherein the sintered body is an external gear or an internal gear.

7. The method of making a sintered body as claimed in claim 1, wherein a relative density of the high-density portion is greater than or equal to 97%.

* * * * *